US007306359B2

(12) United States Patent
Harwood

(10) Patent No.: US 7,306,359 B2
(45) Date of Patent: Dec. 11, 2007

(54) RECESSED ADJUSTABLE LOW VOLTAGE TRACK LIGHTING

(76) Inventor: Ronald P. Harwood, 31110 Applewood, Farmington Hills, MI (US) 48331

( * ) Notice: Subject to any disclaimer, the term of this patent is extended or adjusted under 35 U.S.C. 154(b) by 78 days.

(21) Appl. No.: 11/060,121

(22) Filed: Feb. 17, 2005

(65) Prior Publication Data

US 2005/0254263 A1 Nov. 17, 2005

Related U.S. Application Data

(60) Provisional application No. 60/569,969, filed on May 11, 2004.

(51) Int. Cl.
*H01R 33/00* (2006.01)

(52) U.S. Cl. ..... 362/648; 362/382; 362/419; 362/432; 362/418

(58) Field of Classification Search ..... 362/226, 362/404, 250, 418, 146, 147, 648, 382, 494; 248/287.1, 295.11
See application file for complete search history.

(56) References Cited

U.S. PATENT DOCUMENTS

| | | | | | |
|---|---|---|---|---|---|
| 4,025,777 | A * | 5/1977 | Hayakawa | ..... | 362/250 |
| 4,731,710 | A * | 3/1988 | Distasio | ..... | 362/147 |
| 5,022,720 | A * | 6/1991 | Fevig et al. | ..... | 312/223.5 |
| 5,655,833 | A * | 8/1997 | Raczynski | ..... | 362/419 |
| 5,800,048 | A * | 9/1998 | Gordin | ..... | 362/275 |
| 5,833,358 | A * | 11/1998 | Patik | ..... | 362/391 |

* cited by examiner

*Primary Examiner*—Renee Luebke
*Assistant Examiner*—Evan Dzierzynski
(74) *Attorney, Agent, or Firm*—Marshall & Melhorn, LLC

(57) ABSTRACT

A recessed, adjustable, low voltage track light is shown comprising a recess housing made of any suitable material, and having one or more low voltage lighting rails fixed, or adjustably mounted, within the housing. One or more low voltage lamps can be mounted to the lighting rail or rails anywhere along their linear length. A low voltage power supply is electrically connected to the lighting rail or rails. The low voltage power supply may be mounted within or without the housing. The housing may be installed within a ceiling or wall cavity, or be suspended in space.

24 Claims, 3 Drawing Sheets

RECESSED ADJUSTABLE LOW VOLTAGE TRACK LIGHTING

RELATED APPLICATION

This application claims the benefit of U.S. Provisional Application, Ser. No. 60/569,969, filed May 11, 2004, which application is incorporated herein in its entirety. Application Ser. No. 60/569,969 is co-pending as of the date of the present application.

BACKGROUND OF THE INVENTION

1. Field of the Invention

The present invention relates to lighting. More particularly, the present invention relates to lighting fixtures such as lighting rails and lighting tracks. Most particularly, the present invention relates to recessed, adjustable, low voltage track lighting, which may comprise a mechanically adjustable lighting rail or rails within a recess housing.

2. Description of the Related Art

Lighting rails are known in the industry. While generally similar to "track lighting", lighting rails are generally low voltage, either 12 or 24 volts, and can be touched by humans without danger. In contrast, "track lighting" is high voltage, usually 120 volts, and requires insulated electrodes, which cannot safely be touched by humans.

Known lighting rails, like "track lighting", are surface mounted, or generally installed below the ceiling. Lighting rails and lighting tracks allow for the positioning of lamp holders along their linear electrical surface.

There is a growing demand for smaller and more flexible light fixtures. There is also an increasing demand for lighting fixtures to be concealed, or semi-concealed. However, the necessity, until the present invention, of surface mounting lighting rails or "track lighting" conflicts with the desire to have smaller, more flexible, and recessed lighting fixtures. Thus, a search for a satisfactory solution of how to achieve this has continued in the art.

SUMMARY OF THE INVENTION

The present invention solves the aforementioned problems in the lighting art by coupling a lighting rail or rails in a recess housing which allows the rails to have free space in the housing so that the rails can be adjusted or fastened in a manner that the light can be seen below the rail location. The lighting rails are electrically connected to a source of low voltage electrical energy, which supplies electricity to lamp holders and other devices attached to the lighting rail.

By providing the necessary recess housing, and adjustably mounting the rail within the housing, the rail and the lamp holders can be concealed or partially concealed within the housing, or semi-recessed, allowing the lamp holders to focus adjustably from straight down (0° from the nadir or vertical) to horizontal (90° from the nadir or vertical). Moreover, the recessed lighting rail can also power supplementary light sources to create effects within the housing itself.

The combination of lighting rails within a housing allows for one or many light sources, either of direct or indirect lighting, in a flexible or adjustable manner. The present invention provides a unique method of installation and unique lighting methods previously not achievable in a reasonable manner. The invention couples a housing of any material with a low voltage (generally meaning 24 volts or less) lighting rail that may or may not be adjustable along a substantially vertical axis, or an inclined axis, and may or may not be parallel to the sides of the housing.

This combination allows for a fully or partially recessed rail that may or may not be adjusted to allow the lamp holders, as well as the rail, to be concealed above, or be "flush" with the bottom of the housing. Said housing can be installed within a ceiling or wall cavity or suspended in space. The housing may be of a generally parallelepiped (square or rectangular), or substantially parallelepiped (square or rectangular with rounded edges) shape. The housing may also be a circular housing, domed, or any other desired shaped housing. Generally, there would not be, but could be, a translucent panel forming the bottom of the housing, so that the light may shine freely from the lamp holder that is attached to the lighting rail.

In addition to the housing, there can be a reflector installed just below the top or roof of the housing. This reflector can bounce stray light from the lamp holders out of the housing. Additionally, the lamp holders and lamps can be positioned so that the light points towards the reflector and is redirected, or bounced out of the housing, the effect of which is to "light" the housing reflector in a manner that is aesthetically pleasant.

Also, the lamp sources, which point towards the housing reflector, can be tinted with gels or color lenses, creating the effect of the housing being a glowing color. In addition, the lighting rail can be used in combination with secondary light sources, such as LED light sources, to provide a colorful glow to the housing, while the primary lamp holders are directing light downwardly out of the housing to light the general space, merchandise, art, apparels, walkways or other desired items.

The housing may or may not contain a low voltage transformer/power supply. Also the transformer/power supply may or may not be remotely controlled. A trim bezel may be used with the housing for recessed ceiling mounting.

There may be one or a plurality of both the primary and secondary light sources.

It is to be understood that the present invention is not limited to the details of construction and arrangements of parts illustrated in the accompanying drawings, since the present invention is capable of other embodiments and of being practiced or carried out in various ways within the scope of the claims. Also, it is to be understood that the phraseology and terminology employed herein is for the purpose of description only, and not of limitation.

DETAILED DESCRIPTION OF THE PREFERRED EMBODIMENTS

Figure 1:
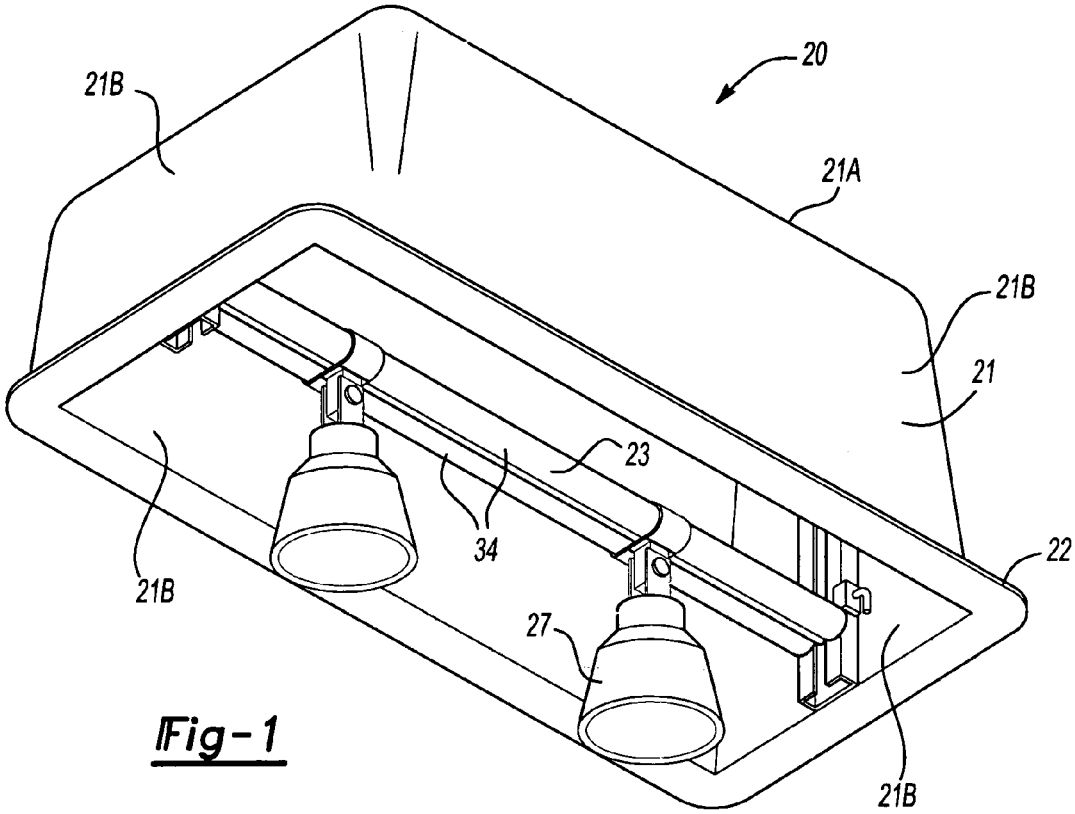
FIG. 1 is a perspective view of a construction embodying the present invention.
Figure 2:
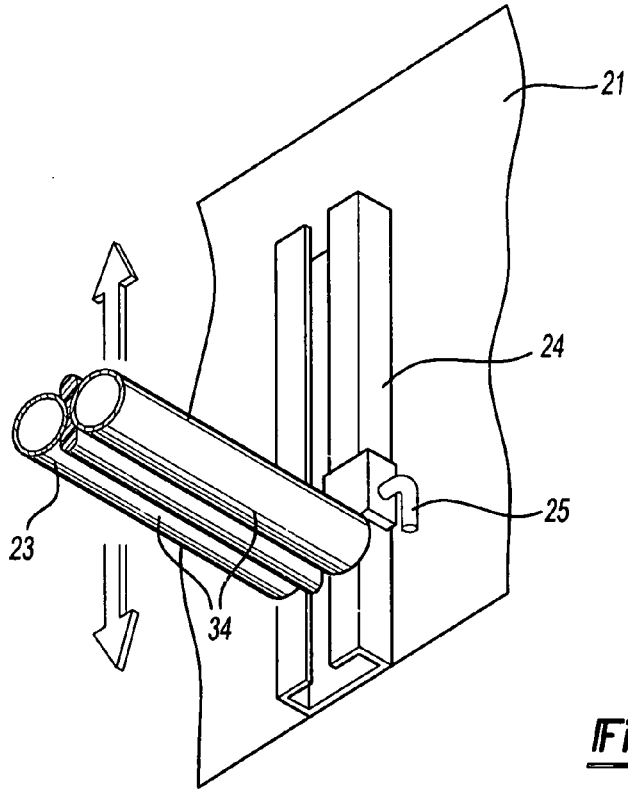
FIG. 2 is an enlarged view of the construction shown in FIG. 1, partially broken away, showing the adjustability feature of a lighting rail within the housing.
Figure 3:
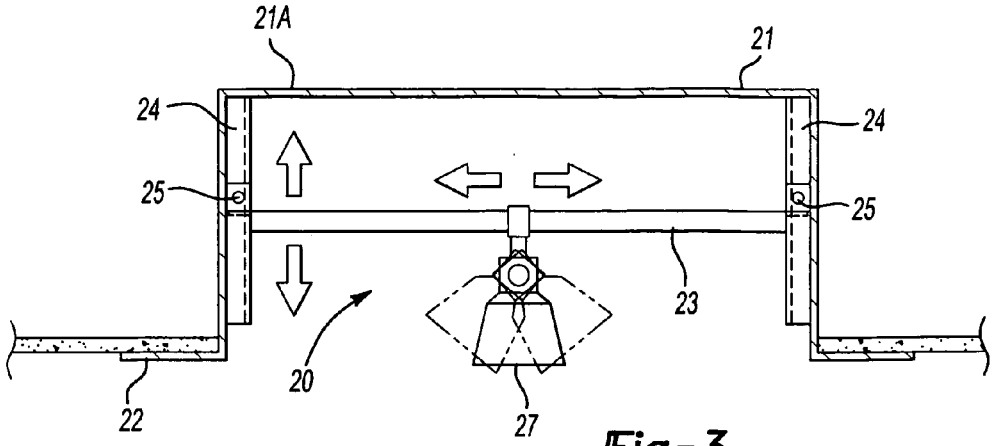
FIG. 3 is an elevational sectional view of the construction shown in FIG. 1.

Referring to FIGS. 1-3, there is illustrated a recessed adjustable low voltage track lighting fixture embodying the present invention, and generally designated by the numeral

20. The lighting fixture 20 comprises a housing 21, which may be made of any practical material, and a flange, and/or trim ring and/or bezel 22 (optional) which may be used to fill in the gaps between the housing 21 and the ceiling, wall, or other location, in which the light fixture 20 is installed.

A low voltage lighting rail 23, which may be such as that manufactured by Bruck Lighting of Costa Mesa, Calif., is adjustably mounted within the housing 21 by means of brackets 24 mounted to sidewalls 21B. An adjusting means 25, which may be any suitable adjusting means, all of which are known in the art, adjustably couples lighting rail 23 to brackets 24. The lighting rail 23 is electrically connected to a low voltage power supply by means well known in the art. The power supply (not shown) may or may not be mounted on the housing 21, and may or may not be remotely controlled. The lighting rail 23 may or may not be parallel to the sidewalls 21B of the housing 21, or the roof or the top of the housing 21A. The shape of the housing is preferably, but not necessarily, rectangular.

Mounted to the lighting rail 23 may be one or more adjustable light fixtures 27, which may be such as the Model No. V/A Calo II 35/51 manufactured by Bruck Lighting of Costa Mesa, Calif., or any other of a number of such fixtures well known in the art.

Preferably the lighting rail 23 extends linearly, and the one or more adjustable fixtures 27 are adjustable along the full length of the lighting rail 23. Preferably, the lighting rail 23 should be at least 10 to 12 inches long.

Figure 4:
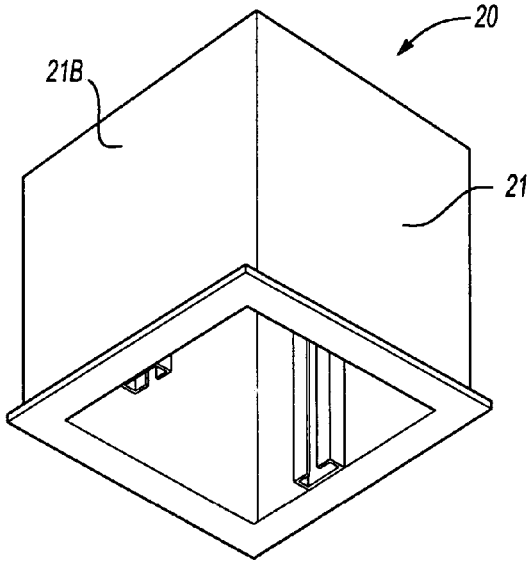
FIG. 4 is a perspective view of a modification of the present invention.
Figure 5:
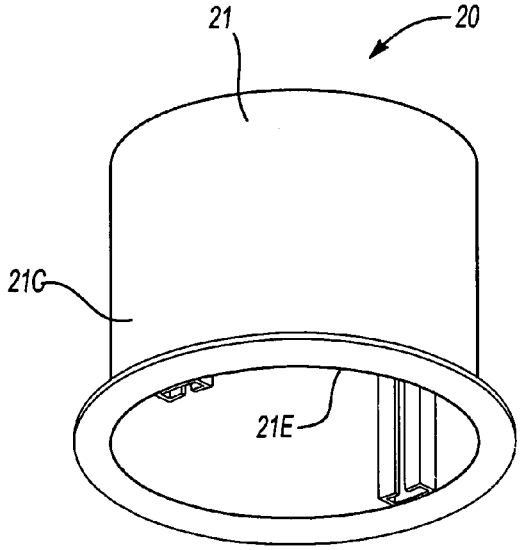
FIG. 5 is a perspective view of a further modification of the present invention.
Figure 5A:
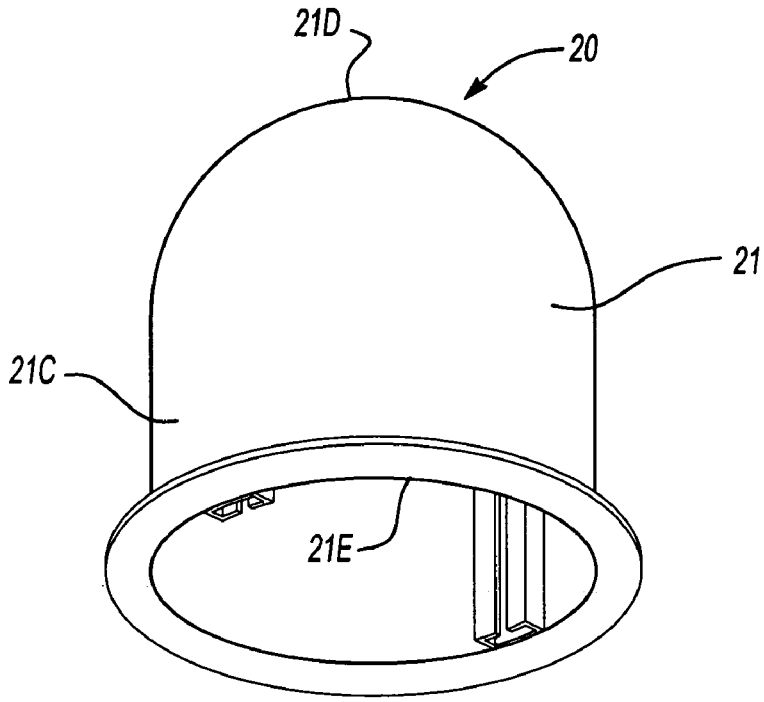
FIG. 5A is a perspective view of another further modification of the present invention.

As shown in FIG. 4, the recessed, adjustable low voltage track lighting fixture 20 may have a square housing 21B, or as shown in FIG. 5, have a circular shaped housing 21C. Any other shape is well within the scope of the present invention, for example, a circular housing with a domed hemispheric top 21D, as shown in FIG. 5A. In the circular shaped housing 21C shown in FIG. 5, and in the domed housing 21D as shown in FIG. 5A, the sidewalls 21B are preferably replaced with a single continuous sidewall 21E which, as illustrated, may be circular in shape.

Figure 6:
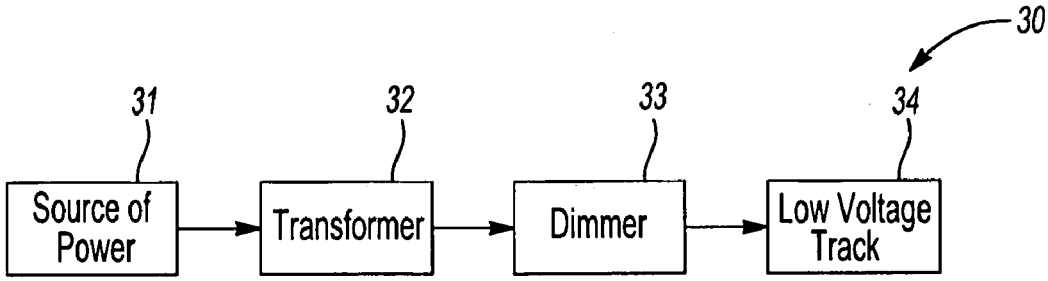
FIG. 6 is a schematic wiring diagram showing how power may be supplied to a construction embodying the present invention.

FIG. 6 shows a typical wiring diagram, generally designated by the numeral 30, where a source of power 31 is in electrical communication with a transformer/power supply 32. The source of power 31 would be in the nominal range of 120-240 VAC, and the transformer/power supply 32 would supply a low voltage of, for example, 12-24 volts. In turn, the transformer/power supply 32 would be utilized to communicate the low voltage to a low voltage track 34 that is located in the lighting rail 23, within the lighting fixture 20. The instant invention, however, is not limited by the range of the incoming voltage or by the low voltage output.

Also shown in FIG. 6 is an optional dimmer 33 that is common in the art, which may be used to manually or automatically control the magnitude of the low voltage supplied to the low voltage track 34, by the transformer/power supply 32, thus effectively controlling the intensity of the light supplied by the lighting fixture 20. However, the present invention is not limited by the use of the dimmer 33, or by the type of the dimmer 33 utilized in the wiring diagram 30.

The invention claimed is:

1. An adjustable, low voltage light fixture comprising:

a) a housing having top and sidewalls and defining a space within the housing;

b) a pair of brackets vertically mounted in an opposed position within the housing on the sidewalls; and c) a low voltage lighting rail extending linearly in the housing between the sidewalls and slidably connected to the brackets.

2. The light fixture of claim 1, and further comprising:

a) at least one low voltage light fixture mounted to the low voltage lighting rail.

3. The light fixture of claim 2, and further comprising:

a) a transformer connected to the lighting rail; and b) a source of power connected to the transformer.

4. The light fixture of claim 3, further comprising a dimmer interposed between the transformer and the lighting rail.

5. The light fixture of claim 2, wherein the lighting rail is connected to the brackets by adjusting means and is adjustable vertically within the housing.

6. The light fixture of claim 2, wherein the low voltage light fixture may be mounted in any desired position along the linear extent of the low voltage lighting rail.

7. The light fixture of claim 2, wherein the low voltage lighting rail comprises a low voltage track, and the adjustable light fixture is in electrical communication with the low voltage track.

8. The light fixture of claim 2, wherein the housing is a recessed housing.

9. The light fixture of claim 1, wherein the lighting rail is connected to the brackets by adjusting means and is vertically adjustable within the housing.

10. The light fixture of claim 1, wherein the housing is a recess housing.

11. The light fixture of claim 10, wherein the housing is rectangular.

12. The light fixture of claim 10, wherein the housing is square.

13. The light fixture of claim 10 mounted in a ceiling of a building.

14. The light fixture of claim 1, wherein the sidewalls are replaced by a single continuous sidewall, and the pair of brackets are mounted in opposed positions within the housing on the single continuous sidewall.

15. The light fixture of claim 14, wherein the lighting rail is connected to the brackets by adjusting means and is adjustable vertically within the housing.

16. The light fixture of claim 14, and further comprising:

a) at least one low voltage light fixture mounted to the low voltage lighting rail.

17. The light fixture of claim 16, and further comprising:

a) a transformer connected to the lighting rail; and b) a source of power connected to the transformer.

18. The light fixture of claim 17, and further comprising a dimmer interposed between the transformer and the lighting rail.

19. The light fixture of claim 16, wherein the adjustable light fixture may be mounted in any desired position along the linear extent of the lighting rail.

20. The light fixture of claim 19, wherein the housing is domed.

21. The light fixture of claim 19, wherein the housing is circular.

22. The light fixture of claim 21, wherein the low voltage lighting rail has a low voltage track, and the adjustable light fixture is in electrical communication with the low voltage track.

23. The light fixture of claim 19, mounted in a ceiling of a building.

24. The light fixture of claim 16, wherein the low voltage lighting rail has a low voltage track and the adjustable light fixture is in electrical communication with the low voltage track.

* * * * *